US006283793B1

(12) United States Patent
Nakata

(10) Patent No.: US 6,283,793 B1
(45) **Date of Patent: *Sep. 4, 2001**

(54) ELECTRICAL CONNECTOR SYSTEM

(75) Inventor: Naohisa Nakata, Tokyo (JP)

(73) Assignee: Hirose Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/243,423

(22) Filed: Feb. 3, 1999

(30) Foreign Application Priority Data

Feb. 4, 1998 (JP) ..... 10-038031

(51) Int. Cl.[7] ..... H01R 9/03
(52) U.S. Cl. ..... 439/610; 439/404
(58) Field of Search ..... 439/610, 607, 439/608, 609, 400, 394, 407, 404, 395, 456, 459

(56) References Cited

U.S. PATENT DOCUMENTS 2,920,129 * 1/1960 Rapata ..... 439/456
4,224,465 * 9/1980 Ruzic ..... 174/135
4,449,778 * 5/1984 Lane ..... 439/608
4,628,410 * 12/1986 Goodman et al. ..... 361/413
5,171,161 * 12/1992 Kachlic ..... 439/352
5,222,909 * 6/1993 Nomura et al. ..... 439/607
5,244,415 9/1993 Marsilio .
5,593,315 1/1997 Kinoshita .
5,954,841 * 9/1999 Ozai et al. ..... 439/608

FOREIGN PATENT DOCUMENTS 0620614 10/1994 (EP) .
0752737 1/1997 (EP) .

* cited by examiner

*Primary Examiner*—Gary Paumen
*Assistant Examiner*—Ross Gushi
(74) *Attorney, Agent, or Firm*—Kanesaka & Takeuchi

(57) ABSTRACT

A male terminal unit 20 (female terminal unit 80) is made by providing core wires 55-1 and 55-2 of a shield cable 52 (102) in a male (female) conductor receiving channels 44 and 45 which are provided in a male holding block 23 (female holding block 83) such that they are held at the engaging shoulders 44-1 and 45-1, placing the male holding block 23 (female holding block 83) on a male insulation block 22 (female insulation block 82) such that the core wires 55-1 and 55-2 are connected under pressure to the press-connection sections 40-1 and 40-2 (female press-connection section 100-1 and 100-2) of the male terminal 24-1 and 24-2 (female terminals 84-1 and 84-2).

8 Claims, 12 Drawing Sheets

ELECTRICAL CONNECTOR SYSTEM

BACKGROUND OF THE INVENTION

1. Filed of the Invention

The present invention relates to an electrical connector system consisting of a pair of electrical connectors for connecting a pair of electrical cables.

2. Description of the Related Art

Japanese UM patent application Kokoku No. 8-9899 discloses an electrical connector system consisting of male and female connectors each comprising a connector housing, a male or female terminal unit provided in the housing, and a retainer provided in the housing, respectively.

As FIG. 20 shows, the male terminal unit 130 is made by providing an insulation block 134 for supporting a male terminal 133 in the tubular section 132 of a shield member 131 and crimping a pair of press-connection tabs 136 and a pair of outer sheath press-connection tabs 140 on the outer conductor (meshed or wounded shield) 139 and the outer sheath 141 of a shield cable 137, respectively, to connect under pressure the inner conductor 142 of the shield cable 137 to the press-connection section 143 of the male terminal 133.

Also, the female terminal unit is made by providing an insulation block with a female terminal in the shield tubular section of a shield member, crimping a pair of shield press-connection tabs and a pair of outer sheath press-connection tabs on the outer conductor and the outer sheath of a shield cable, respectively, to connect under pressure the inner conductor of the shield cable to the press-connection section of the female terminal.

The male and female connectors are plugged into each other by fitting the fitting section of the female connector to the fitting cavity of the male connector and inserting the shield tubular section of the female connector into the shield tubular section 132 of the male connector to bring the male and female shield members into contact with each other, and engaging the male and female lock members.

As FIG. 21 shows, the shield cable 137 comprises a pair of core wires 145 each having a plurality of inner conductors 142 provided with an insulation layer 144, an outer conductor 139 covering the core wires 145, and an outer sheath 141 covering the outer conductor 139.

In the above conventional electrical connector, however, the inner conductor 142 of the shield cable 137 is not connected to the press-connection section 133 of the male terminal 133 so that if the shield cable 137 receives a pull, the inner conductor 142 is separated from the press-connection tabs 143, making the connection unreliable.

The above shield cable has various cross-sections and the core wires 145 is so close to the outer conductor 139 that the cutting blade of an automatic machine does not work. If the cutting amount is too small, the outer sheath 141 and conductor 139 cannot be stripped. If the cutting amount is too large, the outer conductor 139 and/or the core wire 142 is damaged. Thus, setting a proper cutting amount has been too difficult to provide an automatic termination operation.

SUMMARY OF THE INVENTION

Accordingly, it is an object of the invention to provide a reliable electrical connector having a stable press-connection even if the shield cable is pulled.

According to an aspect of the invention, there is provided an electrical connector comprises a terminal unit made by providing a holding block with an inner conductor receiving channel having an engaging shoulder and placing the holding block on the insulation block provided in the shield member such that the core wire in the inner conductor receiving channel is connected under pressure to the press-connection section of a terminal.

Since the core wires of a cable is held at the engaging shoulder, if the cable is pulled, no force is applied to the press-connection portion of the cable, thus stabilizing the pressure-connection and providing a reliable electrical connector.

According to another aspect of the invention there is provided an electrical connector system for a pair of cables comprising a male connector comprising a male connector housing and a male terminal unit provided in the male connector housing and having a male terminal and a female connector comprising a female connector housing and a female terminal unit provided in the female connector housing and having a female terminal; the male terminal unit comprising a male shield member; a male insulation block provided in the male shield member; and a male holding block with a male inner conductor receiving channel having an engaging shoulder, the male holding block being placed on the male insulation block such that core wires in the male inner conductor receiving channel is connected under pressure to a press-connection portion of the male terminal; and the female terminal unit comprising a female shield member; a female insulation block provided in the female shield member; and a female holding block with a female inner conductor receiving channel having an engaging shoulder, the female holding block being placed on the female insulation block such that core wires in the female inner conductor receiving channel is connected under pressure to a press-connection portion of the female terminal.

Since the core wires of a pair of cables are held at the engaging shoulders in the male and female connectors, respectively, if the cables are pulled, no force is applied to the press-connection portion of the cables, thus stabilizing the press-connection and providing a reliable electrical connector system.

According to still another aspect of the invention there is provided an electrical connector wherein the shield member comprises a shield tubular section for accommodating the insulation block and a holding block shield section for accommodating the holding block; the holding block shield section comprising a pair of opposing shield plates having lock unit made such that when the holding block is inserted, the shield plates first are flexed outwardly and then returned to lock the holding block to the shield plates.

When the holding block is inserted in the holding block shield section, the shield plates are flexed outwardly by the lock unit and then return to make a lock, thus facilitating the assembling.

According to yet another aspect of the invention there is provided an electrical connector which further comprising a shield cover provided to cover the holding block locked to the holding block shield section.

With such a structure as defined above, the terminal is shielded completely.

According to another aspect of the invention there is provided an electrical connector system comprising a pair of electrical connectors each comprising a connector housing; a terminal unit provided in the connector housing; a terminal provided in the terminal unit. One of the electrical connectors is made of the surface-mounting type. The terminal unit of the other electrical connector comprising a shield member; an insulation block provided in the shield member; and a holding block with an inner conductor receiving channel having an engaging shoulder, the holding block being placed on the insulation block such that a core wire in the inner conductor receiving channel is connected under pressure to a press-connection portion of the terminal.

One of the connectors can be mounted on a board. Since the engaging shoulder is provided in the other connector, if a pull is applied to the cable, no force is applied to the press-connection portion of the cable, thus stabilizing the press-connection and providing a reliable electrical connector.

According to still another aspect of the invention there is provided an electrical connector wherein the engaging shoulder is made by bending the inner conductor receiving channel.

In the above structure the engaging shoulder is made with a curved channel.

According to yet another aspect of the invention there is provided an electrical connector wherein the engaging shoulder comprises a bottom surface and a vertical surface extending at right angles with the bottom surface.

In the above structure the engaging shoulder is made with a bottom surface of the inner conductor receiving channel and a vertical surface normal to the bottom surface.

According to another aspect of the invention there is provided an electrical connector wherein the engaging shoulder is made by bending the inner conductor receiving channel in a plane parallel to a top surface of the holding block.

In the above structure, the engaging shoulder is made by providing a curved inner conductor receiving channel in a plane parallel to the top surface of the holding block.

According to still another aspect of the invention there is provided an electrical connector wherein the electrical connector is made waterproof.

In the above structure the electrical connector is made waterproof.

According to yet another aspect of the invention there is provided an electrical connector wherein the cable comprises a core wire having an insulated inner conductor; an inner sheath provided over the core wire; an outer conductor provided over the inner sheath; and an outer sheath provided over the outer conductor.

With the above structure, the inner sheath separates the core wire from the outer conductor by the thickness of the inner sheath, and the circular inner sheath makes the outer conductor and sheath concentric.

With the above structure, even when the cutting blade is set to advance at a constant rate, it works on the stripped section (outer sheath and conductor) without failure. Since the inner sheath allows the cutting amount to be set large, making the automatic termination operation possible.

Since there is the inner sheath between the core wire and the outer conductor, both the pull resistance and the insulation strength are made effective, providing a high performance electrical connector.

According to yet another aspect of the invention there is provided an electrical connector wherein the cable comprises a plurality of core wires having a plurality of insulated inner conductors; a plurality of dummy wires twisted with the core wires to provide a twisted wire assembly; an inner sheath provided over the twisted wire assembly; an outer conductor provided over the inner sheath; an outer sheath provided over the outer conductor.

The cross-section of a cable is made substantially circular by twisting a plurality of core wires and a plurality of dummy threads and covering them with an inner sheath to thereby provide close contact with a waterproof seal, enhancing the waterproof performance.

According to another aspect of the invention there is provided an electrical connector system, comprising a pair of electrical connectors, each comprising a housing; a terminal unit provided in the housing; and a terminal provided in the terminal unit; the terminal unit comprising a shield member; an insulation block provided in the shield member; and a holding block having an inner conductor receiving channel for accommodating a core wire under a curved condition, the holding block provided on the insulation block such that the core wire is connected under pressure to a press-connection portion of the terminal.

With the above structure, even if the cable is pulled, no force is applied to the press-connection portion, thus stabilizing the press-connection and providing a reliable electrical connector.

According to still another aspect of the invention there is provided an electrical connector wherein the cable is curved in the inner conductor receiving channel.

With the above structure, if the cable is pulled, no force is applied to the press-connection portion, thus stabilizing the press-connection and providing a reliable electrical connector.

DESCRIPTION OF THE PREFERRED EMBODIMENT

Embodiments of the invention will now be described with reference to the accompanying drawings.

Figure 1:
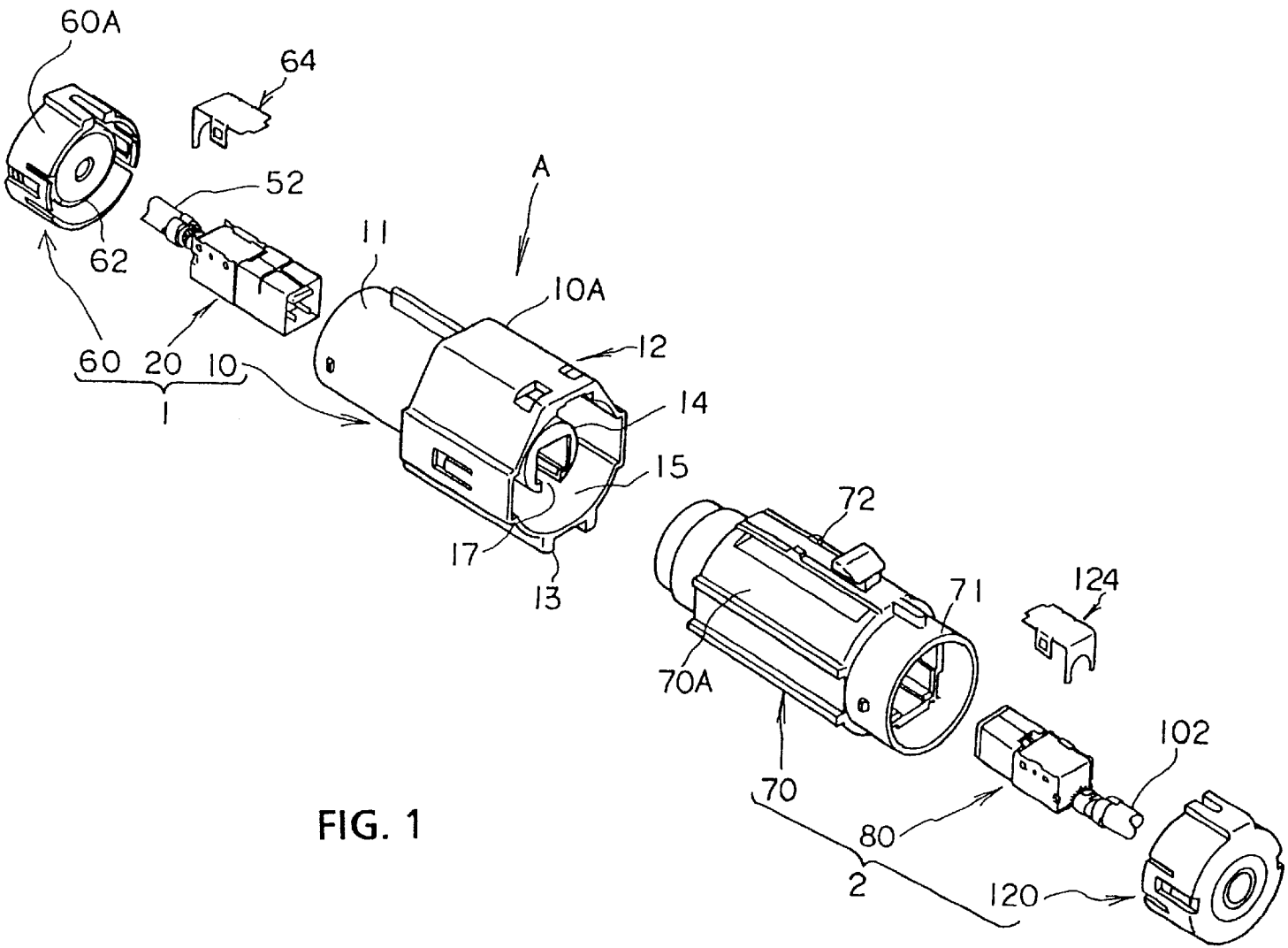
FIG. 1 is an exploded, perspective view of an electrical connector system according to an embodiment of the invention.

In FIG. 1, an electrical connector system (A) consists of a male connector 1 and a female connector 2. The male connector comprises a male connector housing 10, a male terminal unit 20, and a male retainer 60.

Figure 2:
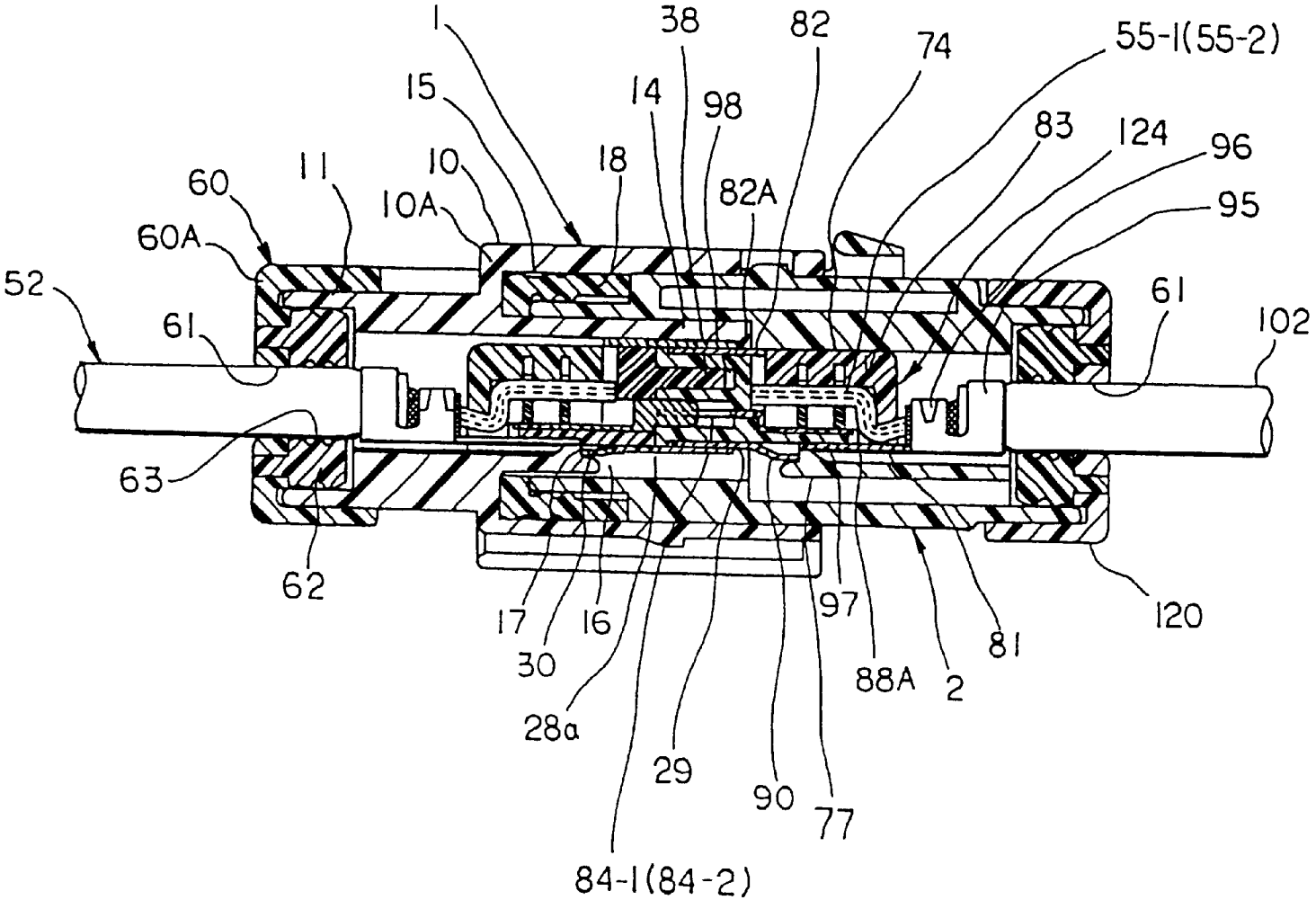
FIG. 2 is a sectional view of the electrical connector system under the connection condition.
Figure 3:
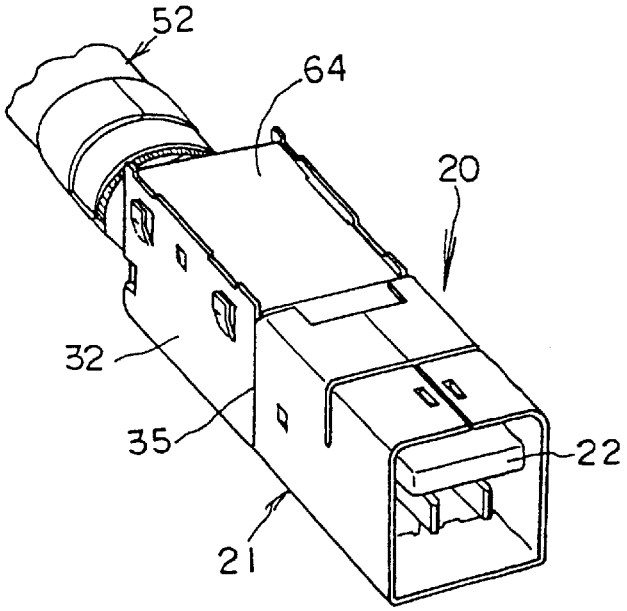
FIG. 3 is a perspective view of a male terminal unit for a male connector of the electrical connector system.

In FIGS. 1 and 2, the male connector housing 10 has a cylindrical housing body 10A which has a retainer attaching section 11 at the rear end. A male lock member 12 and an attaching section 13 are provided on the side of the housing body 10A.

In FIG. 2, a terminal unit attaching section 14 is provided in the housing body 10A defining an annular fitting section 15 between the terminal unit attaching section 14 and the housing body 10A. A cutout portion 16 is provided in the terminal unit attaching section 14 at a position opposite to the male lock member 12. A lance 17 is provided at a bottom of the cutout portion 16. A resilient seal member 18 is set at the fitting section 15.

In FIGS. 3–10, the male terminal unit 20 comprises a male shield member 21 including a male shield cover 64, a male insulation block 22, a male holding block 23 made of an insulation material, and a pair of male terminals 24-1 and 24-2.

Figure 4:
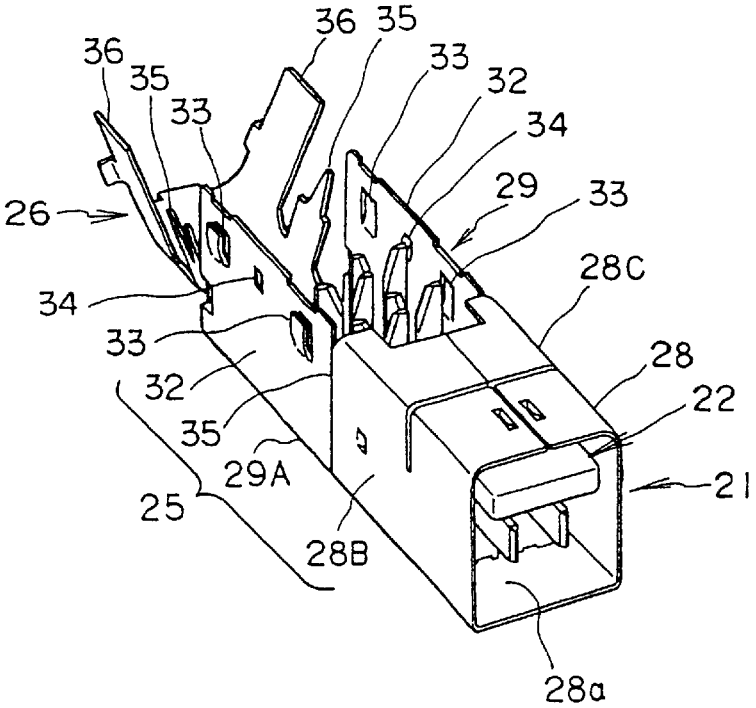
FIG. 4 is a perspective view of the male terminal unit from which the shield cable is removed.

In FIG. 4, the male shield member 21 has a shield section 25 and a press-connection section 26. The shield section 25 has a male shield tubular portion 28 and a male holding block shield portion 29. The male tubular portion 28 has a square cross-section and a lance engaging portion 30 on the bottom 28A. See FIG. 2.

The male holding block shield portion 29 has a pair of male shield plates 32 extending upwardly from a bottom 29A which continues to the bottom 28A. The shield plates 32 are separated from side walls 28B and 28C of the male shield tubular portion 26 by means of cuts 35. A pair of engaging recess 33 are provided in each of the male shield plates. A male engaging projection 34 extends inwardly from the shield plate 32 between the engaging recesses 33. The press-connection section 26 has a pair of shield crimping tabs 35 and a pair of jacket crimping tabs 36.

Figure 5:
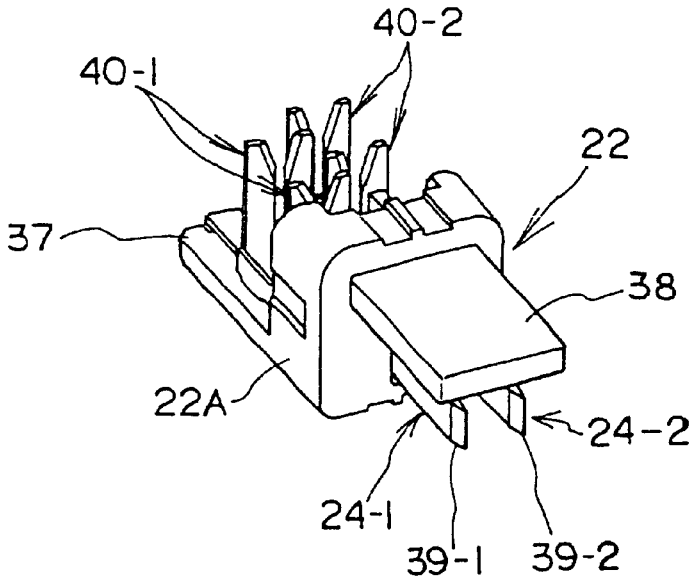
FIG. 5 is a perspective view of the male insulation block for the male terminal unit.

In FIG. 5, the male insulation block 22 has a block body 22A which has a flat press-connection terminal attaching portion 37 at the rear end. A fitting projection 38 extending forwardly from the block body 22A.

The male terminals 24-1 and 24-2 are pushed into the block body 22A. It may be formed by an insert molding method. The male terminals 24-1 and 24-2 have a male contact portion 39-1 or 39-2 and two pairs of press-connection blades 40-1 or 40-2, respectively, which are located on the press-connection terminal attaching portion 37. The male contact portions 39-1 and 39-2 project from the front end of the block body 22A.

Figure 7:
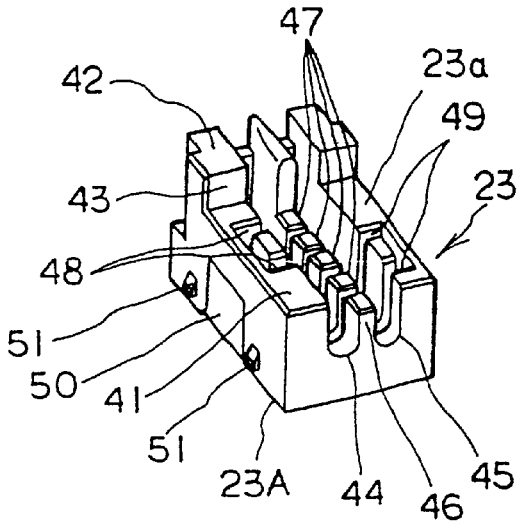
FIG. 7 is a perspective view of a male holding block for the male terminal unit.
Figure 8:
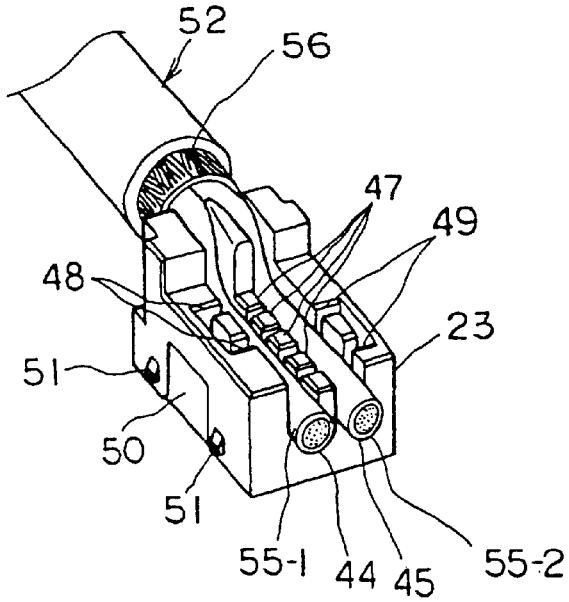
FIG. 8 is a perspective view of the male holding block to which a shield cable is connected.
Figure 9:
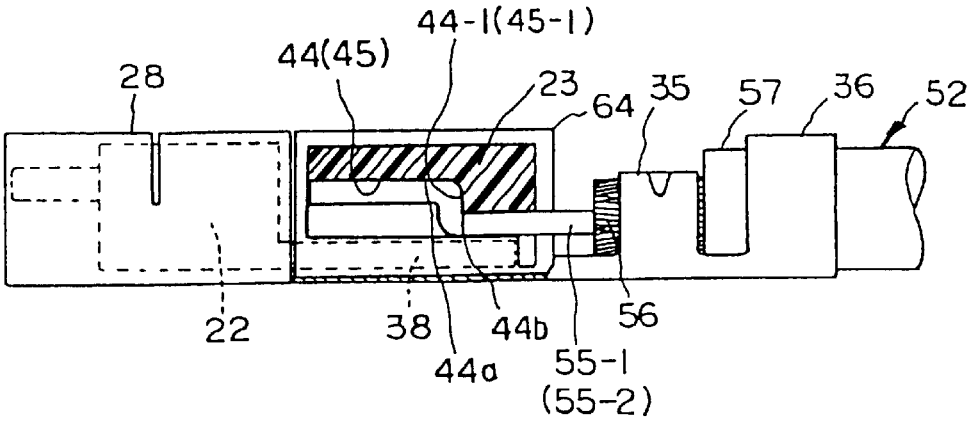
FIG. 9 is a schematic side view of the male terminal unit.
Figure 10:
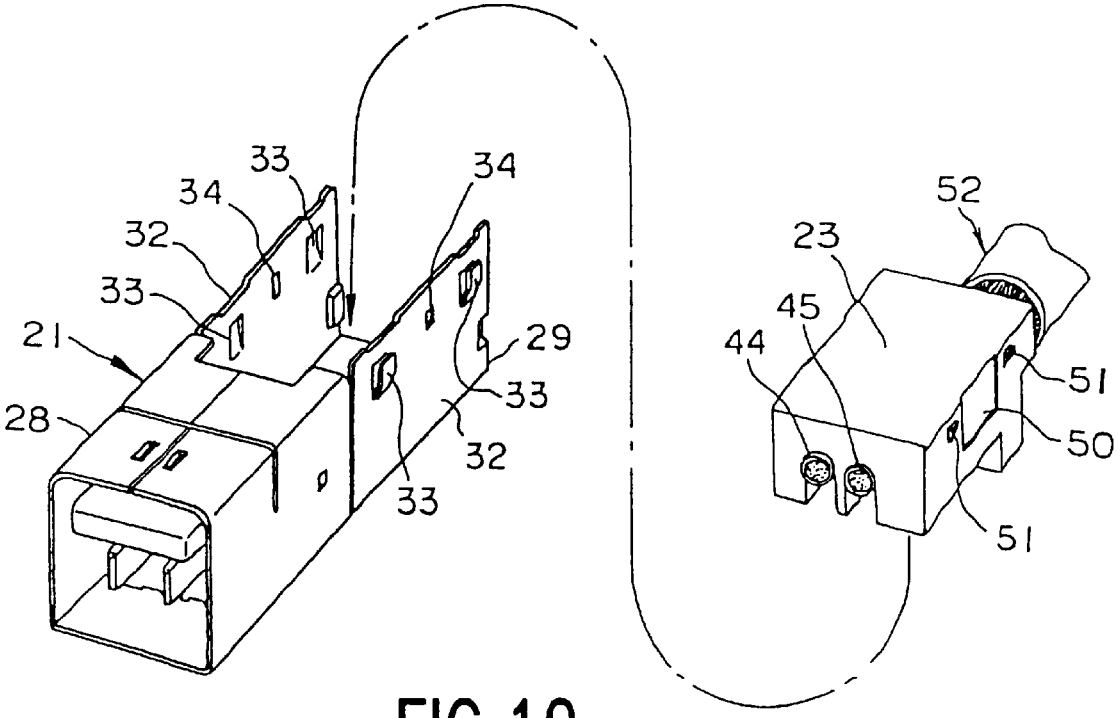
FIG. 10 is a perspective view showing how to assemble the male holding block in the male shield member.

In FIGS. 7–9, the male holding block 23 has a rectangular block body 23A which has a bottom surface 23*a* consisting of two different levels; a first level surface 41 and a second level surface 42 which is higher than the first level surface 41, forming a shoulder 43. A pair of male-side inner conductor (core wire) insertion channels 44 and 45 are provided in the bottom surface 23*a*. The insertion channels 44 and 45 are made parallel to the bottom surface 23*a* so that they are bent at the shoulder 43 of the bottom surface 23*a*, which works as shield wire engaging shoulders 44-1 and 45-1. As shown in FIG. 9, the shield wire engaging shoulders 44-1 and 45-1 each consist of a bottom surface 44*a* of the insertion channel 44 or 45 and a vertical surface 44*b* normal to the bottom surface 44*a*.

Four press-connection tab receiving slits 47 are provided in a middle wall 46 between the male inner conductor receiving channels 44 and 45. Two pairs of press-connection tab receiving slits 48 and 49 are provided on the side walls opposite to the middle wall 46, respectively, corresponding to the respective pairs of slits 47. An indentation 50 is provided on each outside of the block body 23A, and a pair of engaging projections 51 are provided across the indentation 50.

The male insulation block 22 is inserted and locked in the male shield tubular section 28 of the male shield member 28 such that the press-connection terminal attaching portion 37 is located in the male holding block shield section 29 to support the press-connection blades 40-1 and 40-2 of the male terminals 24-1 and 24-2 while the male shield plates 32 are located by the press-connection blades 40-1 and 40-2.

Figure 11:
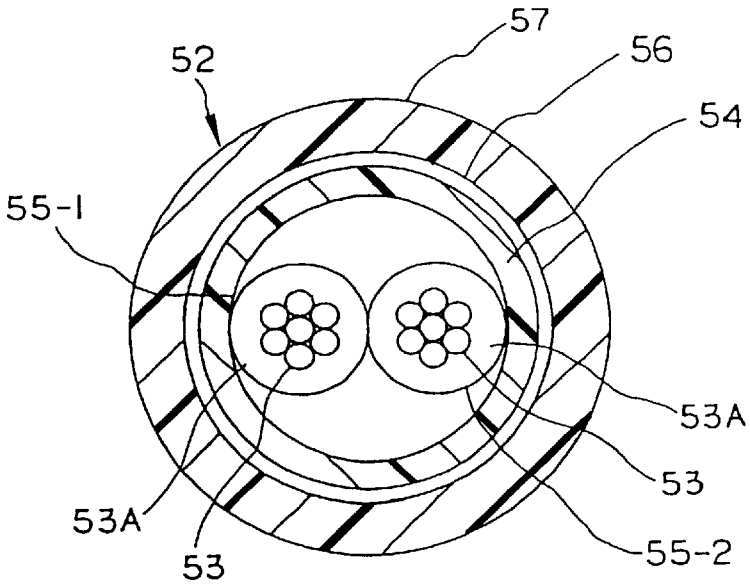
FIG. 11 is a cross-section of a shield cable.

In FIG. 8, a shield cable 52 is connected to the male holding block 23. As shown in FIG. 11, the shield cable 52 comprises a pair of core wires 55-1 and 55-2 having inner conductors 53 and an insulation layer 53A around the conductors 53, an inner sheath 54 around the core wires 55, an outer conductor (meshed shield) 56 around the inner sheath 54, and an outer sheath 57 around the outer conductor 56 and has a circular cross-section.

In FIGS. 1 and 2, the male retainer 60 has a cap-shaped retainer body 60A which has a hole 61 in the end face. An elastic seal member 62 is placed in the retainer body 60A. The elastic seal member 62 is made by providing a mold around the male retainer 60 and filling the mold with rubber to form the elastic seal member having a through-hole 63 concentric with the hole 61.

Figure 13:
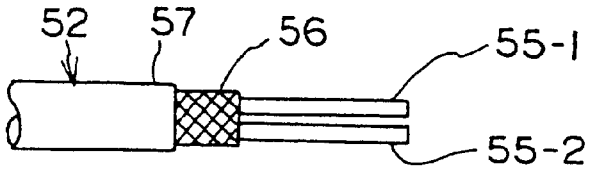
FIG. 13 is a side view of a stripped end of the shield cable.

A The shield cable 52 is connected to the holding block 23 by putting the shield cable 52 through the hole 61 and through-hole 63 to attach the shield cable 52 to the male retainer 60, then, as shown in FIG. 13, removing lengths of the outer sheath 57 and the outer conductor 56 to expose the two core wires 55-1 and 55-2, and placing the core wires 55-1 and 55-2 in the inner conductor receiving channels 44 and 45, respectively.

Then, the core wires 55-1 and 55-2 are connected under pressure to the press-connection blades 40-1 and 40-2 of the male terminals 24-1 and 24-2, respectively, by placing the male holding block 23 in the male holding block shield section 29 such that the core wires 55-1 and 55-2 are opposed to the press-connection blades 40-1 and 40-2 of the male terminals 24-1 and 24-2 placed on the press-connection attaching section 37 and placing the press-connection blades 40-1 and 40-2 in the press-connection receiving slits 47 and 48.

Then, the press-connection tabs 35 of the male shield member 21 and the sheath press-connection tabs 36 are crimped on the outer conductor 56 and the outer sheath 57, respectively.

Figure 6:
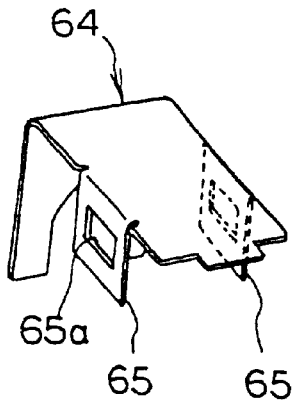
FIG. 6 is a perspective view of a male shield cover for the male terminal unit.

The male shield cover 64 is attached to the male holding block shield section 21 so as to cover the holding block 23. As shown in FIG. 6, the L-shaped cover 64 is provided with a pair of engaging sides 65 having engaging holes 65*a*. The male terminal unit 20 is made by engaging the male engaging projections 34 of the male shield plates 32 with the engaging holes 65*a* of the male shield cover 64.

In the above press-connection operation, when the male holding block 23 is inserted into the male holding block shield section 29, the male shield plates 32 is flexed outwardly by the contact between the engaging projections 34 and the block body 23A. When the male engaging projections 34 are inserted into the indentations 50 of the block body 23A, the male shield plates 32 are flexed back by their elasticity so that the engaging projections 51 of the block body 23A are engaged with the engaging recesses 33 of the male shield plates 32, thus making a lock. The male engaging projections 34, the indentations 50, the engaging projections 51, and the engaging recesses 33 constitute a male lock unit.

Since the core wires 55-1 and 55-2 are connected under pressure to the press-connection blades 40-1 and 40-2 of the male terminals 24-1 and 24-2, respectively, such that they are bent at the engaging shoulders 44-1 and 45-1 of the inner conductor receiving channels 44 and 45, the press-connection is reliable even if the core wires 55-1 and 55-2 are pulled.

The male connector 1 is made by placing the male terminal unit 20 in the terminal unit attaching section of the male connector housing 10 such that the lance 17 is engaged with the lance engaging portion 30 of the male shield tubular member 28 and fitting the male retainer 60 in the retainer attaching section 11 of the male housing 10.

The female connector 2 consists of a female housing 70, a female terminal unit 80, and a female retainer 120.

In FIGS. 1 and 2, the female connector housing 70 has a tubular housing body 70A which has a retainer attaching section 71 at the rear end and a female lock member 72 on the side. The housing body 70A is provided with a terminal unit attaching section 74 which has a lance 77.

Figure 14:
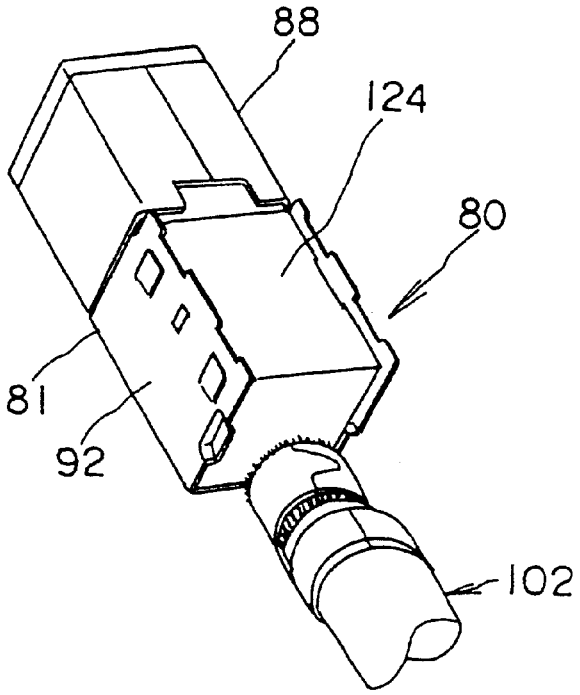
FIG. 14 is a perspective view of a female terminal unit.

In FIG. 14, the female terminal unit 80 comprises a female shield member 81 having a female shield cover 124, a female insulation block 82, a female holding block 83 made of an insulation material, and a pair of female terminals 84-1 and 84-2.

Figure 15:
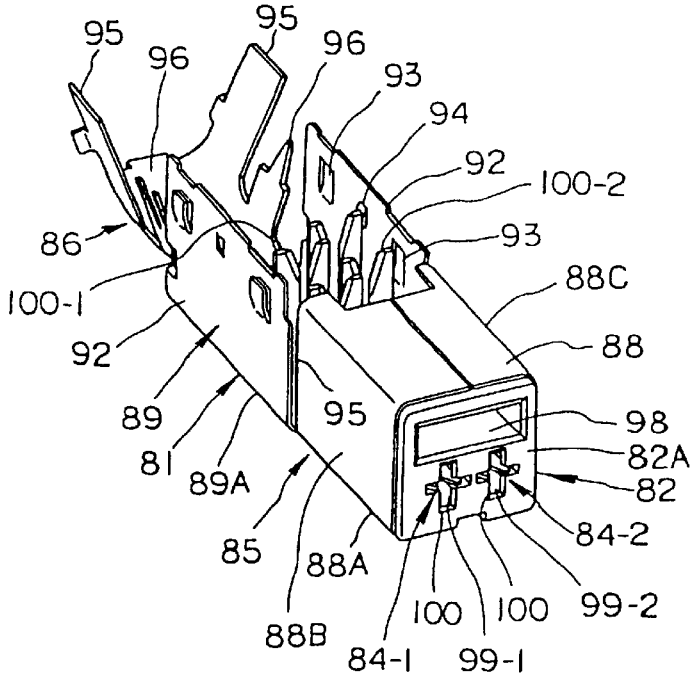
FIG. 15 is a perspective view of the female terminal unit from which the shield cable is removed.

In FIG. 15, the female shield consists of a shield section 85 and a press-connection section 86. The shield section 85 has a female shield tubular member 88 a female holding block shield section 89. The female shield tubular section 88 has a square cross-section and a lance engaging portion 90 on the bottom surface 88A.

The female holding block shield 89 has a pair of female shield plates 92 extending upwardly from a bottom section 89*a* of a bottom surface 88A. The female shield plates 92 are separated from the side walls 88B and 88C of the female shield tubular member 88. A pair of engaging recesses 93 are provided on each of the female shield plates 92, and a female engaging projection 94 extends inwardly from the shield plate 92 between the engaging recesses 93. The press-connection section 86 has a pair of shield press-connection tabs 95 and a pair of sheath press-connection tabs 96.

In FIGS. 2 and 4, the female insulation block 82 has a block body 82A which has a press-connection terminal attaching section 97 at the rear end and a fitting cavity 97 at the front end. A pair of female terminals 84-1 and 84-2 are pushed into the block body 82A. This may also be done by the insert molding method. The female terminals 84-1 and 84-2 have a bifurcated female contact 99-1 and 99-2 and two pairs of press-connection tabs 100-1 and 100-2, respectively, which are located on the press-connection terminal attaching section 97. The female contacts 99-1 and 99-2 are located in the contact holes 100 at the front end of the block body 22A.

The female holding block 83 has a structure identical with that of the male holding block 23, and the same reference numbers are provided, and the description is omitted.

In FIGS. 2 and 4, the female insulation block 82 is placed and locked in the female shield tubular section 88 10 of the female shield member 81 such that the press-connection terminal attaching section 87 is located in the female holding block shield 89 to support the press-connection blades 100-1 and 100-2 of the female terminals 84-1 and 4-2 by the female shield plates 92 located.

In FIG. 2, a shield cable 102 is connected to the female holding block 83. The shield cable 102 and the female retainer 120 have structures identical with the aforementioned shield cable 102 and the retainer 60, respectively.

After the shield cable 102 is attached to the female retainer 120 via the through-hole 61, the two core wires 55-1 and 55-2 are exposed at the end and placed in the female inner conductor receiving channels 44 and 45 to connect the shield cable 102 to the female holding block 83.

Then, the female holding block 83 is placed in the female holding block shield 92 such that the two core wires 55-1 and 55-2 are opposed to the press-connection blades 100-1 and 100-2 of the female terminals 84-1 and 84-2 on the press-connection terminal attaching section 87. Then, two pairs of press-connection blades 100-1 and 100-2 are fitted in the press-connection tab receiving slits 47 and 48 of the female holding block 83 so as to connect under pressure the core wires 55-1 and 55-2 to the press-connection blades 100-1 and 100-2 of the male terminals 84-1 and 84-2, respectively.

Each pair of shield press-connection tabs 95 and the insulation press-connection tabs 96 are crimped on the outer conductor 56 and the outer sheath 57 of the core wires 55-1 and 55-2, respectively.

Then, the female shield cover 124 is attached to the female holding block shield member 92 so as to cover the female holding block 83. The female shield cover 124 has a structure identical with that of the shield cover 64, and the female engaging projections 94 are engaged with the engaging holes 65*a* by sliding the engaging pieces 65 on the insides of the female shield plates 92.

When the female holding block 83 is inserted in the female holding block shield member 89, the female engaging projections 94 are brought into contact with the block body 83A to flex the female shield plates 92 outwardly. When the female engaging projections 94 are inserted in the engaging indentations 49, the female shield plates 92 are flexed back with their resiliency so that the engaging projections 51 of the block body 83A are engaged go with the engaging recesses 93 of the shield plates 92, thus making a lock. The engaging projections 94 and 51 and the engaging recesses 49 and 93 constitute a female lock unit.

The core wires 55-1 and 55-2 of the shield cable 102 are placed in the female inner conductor receiving channels 44 and 45 of the female holding block 83 to connect under pressure to the press-connection blades 100-1 and 100-2 of the female terminals 84-1 and 84-2, respectively, such that the core wires 55-1 and 55-2 are bent at the engaging shoulder 44-1 and 45-1. Consequently, if the core wires 55-1 and/or 55-2 are pulled, they are hooked at the engaging shoulders 44-1 and/or 45-1 so that no force is applied to the press-connection portion, thus stabilizing the press-connection.

Then, the female terminal unit 80 is placed in the terminal unit attaching section 74 of the female connector housing 70 so as to engage the lance 77 with the lance engaging portion 90 provided on the bottom 88A of the female shield tubular member 88 while the female retainer 120 is fitted in the retainer attaching section 71 of the female connector housing 70 to provide the female connector 2.

The plugging operation between the male and female connectors 1 and 2 will be described below.

The male connector 1 is plugged into the female connector by fitting the female connector housing 70 of the female connector 2 into the fitting cavity 15 of the male connector housing 10 to compress the elastic seal member 18, providing water-proof fitting, then, inserting the female shield tubular member 88 of the female shield member 81 into the male shield tubular section 28 of the male shield member 21 for contact to each other, and the fitting projection 22 of the male insulation block 22 into the recess 98 of the female insulation block 82 as well as the male contacts 39-1 and 39-2 into the female contacts 99-1 and 99-2 of the female terminals 84-1 and 84-2 for contact to each other, and finally engaging the male lock member 12 with the female lock member 72.

The connection between the male and female connectors 1 and 2 is released by performing the above procedure in the reverse order.

Figure 16:
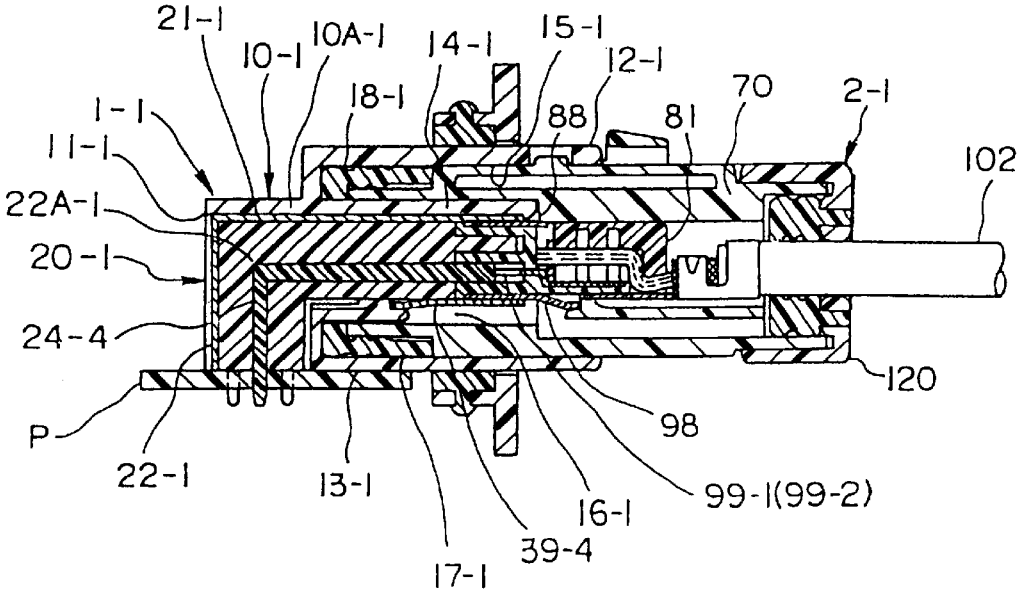
FIG. 16 is an electrical connector system according to the second embodiment of the invention under connection conditions.

In FIG. 16, the male connector 1-1 is made as a substrate mounting type and the female connector 2-1 is made so as to have the same structure as that of the above female connector 2. Since the female connector 2-1 is the same as the female connector 2, the same reference numerals are provided, with the description omitted.

The male connector 1-1 consists of a male connector housing 10-1 and a male terminal unit 20-1.

The male connector housing 10-1 has a tubular housing body 10A-1 which has an opening 11-1 at the rear end and a male lock member 12-1 and a mounting section 13-1 on the side.

The housing body 10A-1 is provided with a terminal unit attaching section 14-1, defining a fitting section 15-1 between the terminal unit attaching section 14-1 and the housing body 10A-1. A slot 16-1 is provided in the terminal unit attaching section 14-1 opposite to the male lock member 12-1, and a lance 17-1 is provided at the rear end of the slot 16-1. An elastic seal member 18-1 is set at the rear end of the fitting section 15-1.

Figure 17:
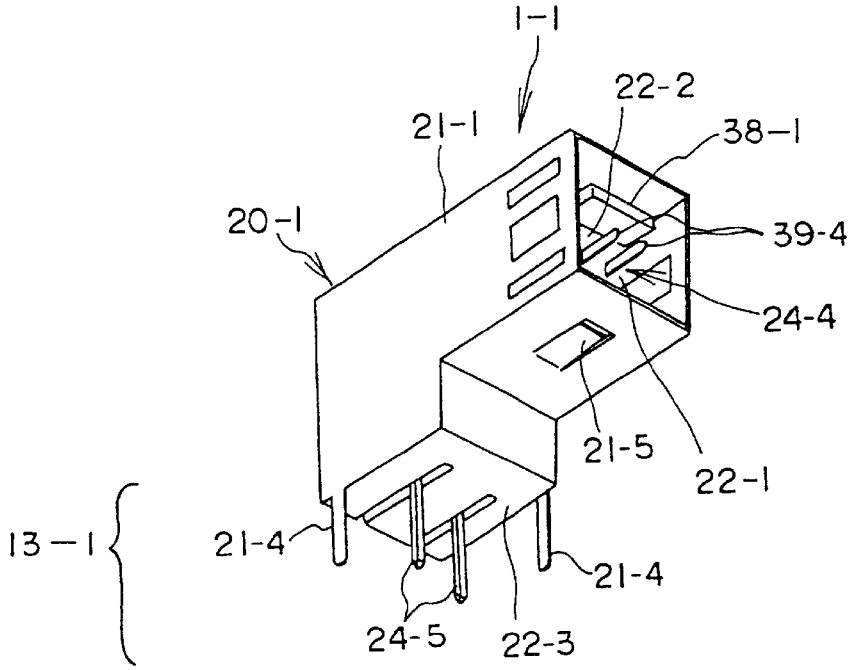
FIG. 17 is a perspective view of a male terminal unit of a male connector.

In FIG. 17, the male terminal unit 20-1 consists of a male shield member 21-1, a male insulation block 22-1, and a pair of male terminals 24-4.

The male insulation block 22-1 has a L-shaped block body 22A-1 which has a fitting projection 38-1 at the front end. A pair of male terminals 24-4 are provided at the block body 22A-1 by the insert molding method such that the male contact portions 39-4 project from the front end 22-2 of the block body 22A-1 while the connection legs 24-5 project from the mounting surface 22-3 of the male insulation block 22-1.

The male shield member 21-1 covers the male insulation block 22-1 except for the front end 22-2 and the mounting surface 22-3 of the male insulation block 22-1. Connection legs 21-4 extend from the mounting ends 21-3 of the male shield member 21-1. A lance engaging portion 21-5 is provided in the male shield member 21-1.

The male terminal unit 20-1 is inserted into the terminal unit attaching section 14-1 of the male connector housing 10-1 from the rear opening 11-1 while the lance 17-1 is engaged with the lance engaging portion 21-5 of the male shield member 21-1 to form the male connector 1-1.

The connection legs 24-5 of the male terminals 24-4 are soldered to the conductor pattern on the printed circuit board (P), with the mounting section 13-1 abutted against the PCB while the connection legs 21-4 of the male shield member 21-1 are connected to the shield portion of the PCB to mount the male connector 1-1 on the PCB.

The male and female connectors 1-1 and 2-1 are connected by fitting the female connector housing 70 of the female connector 2-1 into the fitting cavity 15-1 of the male connector housing 10-1 to compress the elastic seal member 18, thus making water-proof, and inserting the female shield tubular section 88 of the female shield member 81 into the male shield member 21-1 of the male connector 1-1 to bring them into contact, and inserting the fitting projection 38 of the male insulation block 22-1 into the cavity 98 of the female insulation block 82 while the male contact portions 39-4 of the male terminals 24-4 is inserted into the female contact portions 99-1 and 99-2 of the female terminals 84-1 and 84-2 to bring them into contact, and finally engaging the male lock member 12-1 with the female lock member 72.

In FIG. 11, the shield cable 52 or 102 is made by covering a pair of core wires 55-1 and 55-2, which are made by applying an insulation to the inner conductors 53, with a sheath 54, covering the inner sheath 54 with an outer conductor (mesh shield) 56, and covering the outer conductor 56 with an outer sheath 57. The inner sheath 54 separates the core wires 55-1 and 55-2 from the outer conductor 56 by the thickness of the inner sheath 54. By making the cross-section of the inner sheath 54 circular, it is possible to make the outer conductor 56 and the outer sheath 57 concentric regardless of the shape of cross-section of the core wires 55-1 and 55-2.

When the outer sheath 57 or outer conductor 56 is removed, the cutting blade works very well with such a shield cable 52 or 102. The inner sheath 54 between the outer conductor 56 and the core wires 55-1 and 55-2 makes it possible to set a large amount of cut to thereby make automatic termination possible.

The shield cable 52 or 102 is connected to the male holding block 23 or female holding block 83 by stripping the outer sheath 57 and cutting the outer conductor 56 and dummy wire 58 to expose two core wires 55-1 and 55-2 and inserting the core wires 55-1 and 55-2 into the inner conductor receiving channels 44 and 45, respectively.

In FIG. 9, when the core wires 55-1 and 55-2 of the shield cable 52 or 102 are inserted into the male inner conductor receiving channels 44 and 45 of the male or female holding block 23 or 83 to connect under pressure the core wires 55-1 and 55-2 to the press-connection blades 40-1 or 100-1, and 40-2 or 100-2 of the male or female terminals 24-1 or 24-2, the core wires 55-1 and 55-2 of the shield cable 52 or 102 are bent at the engaging shoulder 44-1 or 45-1 of the male or female inner conductor receiving channels 44 or 45. Consequently, if the core wires 55-1 or 55-2 is pulled, the force is stopped at the male or female engaging shoulder 44-1 or 45-1, thus stabilizing the press connection. The inner sheath 54 between the core wires 55-1 and 55-2 and the outer conductor 56 makes effective both the pull resistance and the insulation strength, thereby providing a high performance electrical connector.

When the shield cable 52 or 102 is used for a water-proof electrical connector, the cross-section of the shield cable 52 or 102 becomes substantially circular. Thus, when the shield cable 52 or 102 is put through the hold 61 and the through-hole 63 of the male or female retainer 60 or 120, the shield cable 52 or 102 is brought into close contact with the hole 61 and the through-hole 63, thereby improving the water-proof performance.

Figure 12:
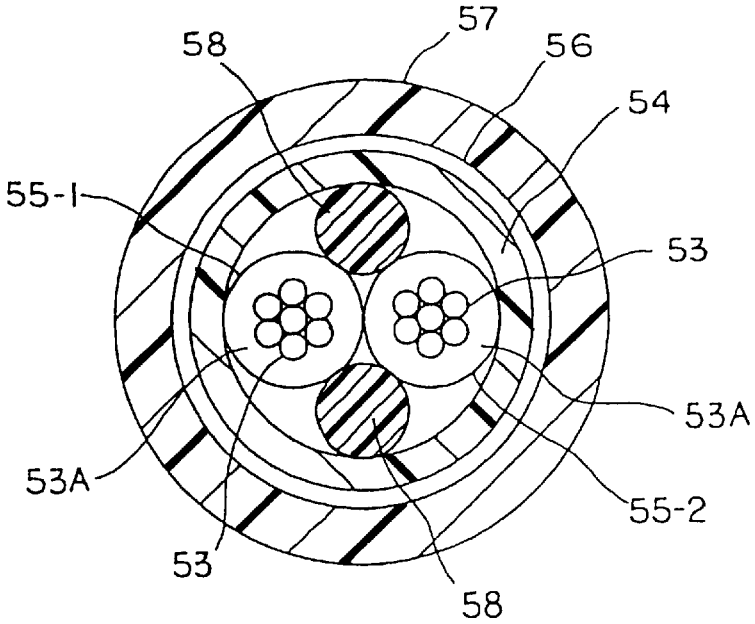
FIG. 12 is a cross-section of a shield cable of another type.

Alternatively, as shown in FIG. 12, the shield cable 52 or 102 is made by twisting a pair of insulated core wires 55-1 and 55-2 with a pair of dummy wires 58 of synthetic thread and covering the wires and threads with an inner sheath 54, then the inner sheath 54 with an outer conductor (meshed shield) 56, and finally the outer conductor 56 with an outer sheath 57. The shield cable 52 or 102 becomes so circular that it is brought into close contact with the water-proof, thus improving the water-proof performance.

Figure 18:
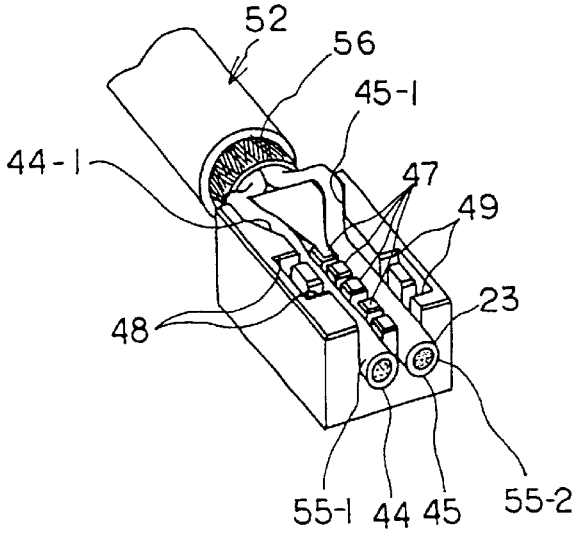
FIG. 18 is a perspective view of a male holding block of the male terminal unit according to the second embodiment.

Alternatively, as shown in FIG. 18, the engaging shoulders 44-1 and 45-1 are made by bending the inner conductor receiving channels 44 and 45 in the surface of the male holding block 23.

Figure 19:
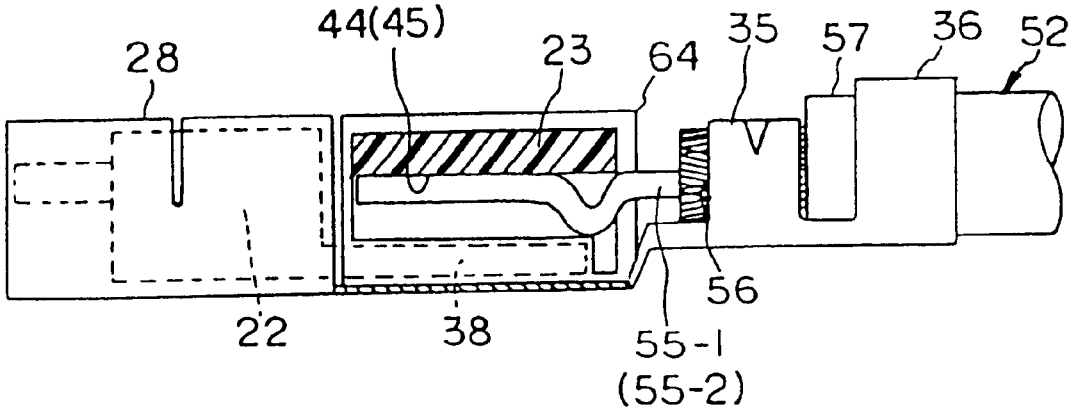
FIG. 19 is a schematic sectional view of the male terminal unit of the male connector.
Figure 20:
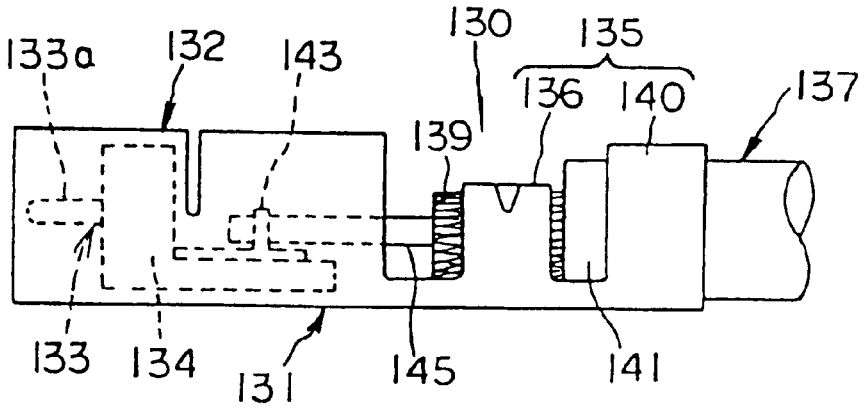
FIG. 20 Prior Art
FIG. 20 is a perspective view of a male terminal unit of a conventional electrical connector.
Figure 21:
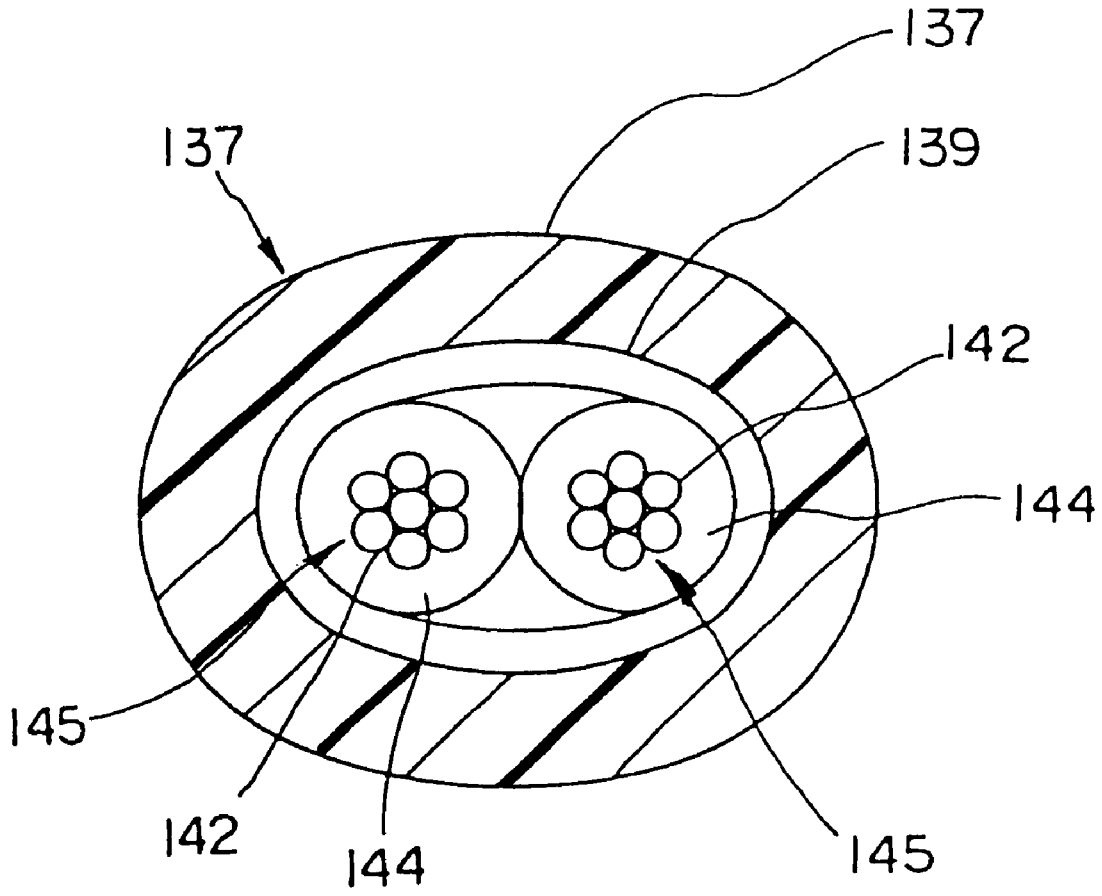
FIG. 21 Prior Art
FIG. 21 is a cross-section of a conventional shield cable.

Alternatively, as shown in FIG. 19, the shield cable core wires 52 in the male inner conductor receiving channels 44 and 45 are connected under pressure to the male press-connection tabs 40-1 of the male terminal 24-1 by providing the male inner conductor receiving channels 44 and 45 having no engaging shoulders 44-1 and 45-1 in the male holding block 23, inserting the shield cable core wires 52-1 and 55-2 into the male inner conductor receiving channels 44 and 45, making them loose (curved), and placing the male holding block 23 on the male insulation block 22. The same is applied to the female terminal unit 80.

Consequently, when the shield cable 52 is pulled, no force is applied to the press-connection portion of the shield cable 52, thus stabilizing the press-connection while the loose portion of the shield cable core wires 52-1 or 55-2 absorbs the force thereby assuring the press-connection of the shield cable 52.

Alternatively, the shield cable core wire 52-1 and 55-2 in the male inner conductor receiving channels 44 and 45 are connected under pressure to the male press-connection blades 40-1 and 40-2 of the male terminal 24-1 and 24-2 by providing the male inner conductor receiving channels 44 and 45 having engaging shoulders 44-1 and 45-1 in the male holding block 23, placing the shield cable 52 in the male inner conductor receiving channels 44 and 45 and making them loose (curved), and placing the male holding block 23 on the male insulation block 22. The same is applied to the female unit 80.

According to the invention described above, the insulated core wires of a cable are placed in the inner conductor receiving channels and held by the engaging shoulders so that if the cable is pulled, the pull is prevented by the engaging shoulders from acting on the press-connection portions thus stabilizing the press-connection and providing a reliable electrical connector.

Since the cable wires are placed in the male inner conductor receiving channels and held by the engaging shoulders while the cable wires are placed in the female inner conductor receiving channels and held by the engaging shoulders, if the cable is pulled, the force is stopped at the male and female engaging shoulders so that no force is applied to the press-connection portions, thus stabilizing the press-connection and providing a reliable electrical connector.

When the holding block is placed in the holding block shield member, the shield plates are flexed outwardly by the lock unit and then returned to an automatic lock condition, making the assembling easy.

With an electrical connector according the invention, it is possible to shield the terminals completely.

With an electrical connector according to the invention described above, it is possible to mount one of the connectors on a board and to place the cable wires in the inner conductor receiving channels such that the cable wires are held at the engaging shoulders so that if the cable is pulled, the pulling force is stopped by the engaging shoulders. Consequently, no pulling force is applied to the press-connection portions of the cables, thus stabilizing the press-connection and providing a reliable electrical connector.

With an electrical connector according to the invention described above, it is possible to make the engaging shoulders by the bent portions of the inner conductor receiving channels.

With an electrical connector according to the invention described above, it is possible to make the engaging shoulder with a bottom surface of the inner conductor receiving channel, and side walls perpendicular to the bottom surface.

With an electrical connector according to the invention described above, it is possible to make the engaging shoulder with the bend portion of a bent inner conductor receiving channel provided in the holding block.

With an electrical connector according to the invention described above, it is possible to the connector water-proof.

With an electrical connector according to the invention described above, it is possible to separate the outer conductor from the core wires by the thickness of the inner sheath and to make the outer conductor and sheath concentric by making the inner sheath circular regardless of the cross-sectional shape of the core wires.

Since there is the inner sheath between the outer conductor and the core wires, it is possible to maximize the amount of cut into the outer sheath and conductor, thus making possible automation of the termination operation.

Since the core wires are bent at the engaging shoulders, even if they are pulled, no pulling force is applied to the press-connection portion, thus stabilizing the press-connection portion. Under such conditions, the inner sheath between the core wires and the outer conductor makes effective both the pulling and insulation strengths, thus providing a high-performance electrical connector.

With an electrical connector according to the invention described above, it is possible to make the cross-section of the cable circular by twisting a plurality of core wires and a plurality of dummies and covering them with an inner sheath, to thereby improve the water-proof performance.

With an electrical connector according to the invention described above, if the cable is pulled, the pulling force is stopped at the engaging shoulder, and no force is applied to the press-connection portion of the cable, thus stabilizing the press-connection portion and providing a reliable electrical connector.

With an electrical connector according to the invention described above, if the cable is pulled, the pulling force is stopped by the engaging shoulder so that no force is applied to the press-connection portion, thus stabilizing the press-connection portion and providing a reliable electrical connector.

What is claimed is:

1. An electrical connector for a cable (12) including at least one core wire (55-1 and 55-2), an inner sheath (54), an outer conductor (56) and an outer sheath (57), said electrical connector comprising;

a housing (10) having a cylindrical housing body (10A);

a shield member (21) including a shield section (25) and a press-connection section (26) having a pair of shield crimping tabs (35) and a pair of jacket crimping tabs (36);

an insulation block (22) provided in said shield member;

a holding block (23) having at least one inner conductor receiving channel (44 or 45), said inner conductor receiving channel extending in a first direction in which said cable is inserted to said inner conductor receiving channel and having at least one engaging shoulder (44-1 or 45-1) having a bottom surface (44*a*) and a vertical surface (44*b*) extending at right angles with said bottom surface, said engaging shoulder provided for receiving said core wire (55-1 or 55-2) of said cable such that said core wire is bent at said engaging shoulder of said inner conductor receiving channel; and at least one terminal (24-1 or 24-2) supported by said insulation block and having a plurality of press-connection blades (40-1 and 40-2) projecting in a second direction perpendicular to said first direction, wherein said holding block is placed on said insulation block such that said core wire of said cable in said inner conductor receiving channel is connected under pressure to said press-connection blades of said terminal, and said shield and jacket crimping tabs of said shield member are press-connected to said outer conductor and outer sheath of said cable, respectively.

2. An electrical connector according to claim 1 which further comprising a shield cover for covering said holding block locked to said holding block shield section.

3. An electrical connector according to 1, wherein said inner sheath has a circular cross-section so that said electrical connector can form waterproof connection with a mating connector.

4. An electrical connector according to claim 1, wherein said cable further comprises a plurality of dummy threads twisted with said core wires to provide a twisted wire assembly.

5. An electrical connector according to 4, wherein said electrical connector is made waterproof by making a cross-section of said inner sheath circular.

6. An electrical connector system for connecting a pair of electrical cables (12) each having at least one core wire (55-1 and 55-2), an inner sheath (54), an outer conductor (56) and an outer sheath (57), said electrical connector system comprising:

a male connector (1) comprising:

a male connector housing (10) having a cylindrical housing body (10A) and a male terminal unit (20) provided in said male connector housing and having at least one male terminal (24-1 or 24-2) and a female connector (2) comprising:

a female connector housing (70) having a cylindrical housing body (70A) and a female terminal unit (80) provided in said female connector housing and having at least one female terminal (84-1 or 84-2); said male terminal unit comprising:

a male shield member (21) including a shield section (25) and a press-connection section (26) having a pair of shield crimping tabs (35) and a pair of jacket crimping tabs (36);

a male insulation block (22) provided in said male shield member; and a male holding block (23) having at least one male inner conductor receiving channel having at least one engaging shoulder (44-1 or 44-2) having a bottom surface (44*a*) and a vertical surface (44*b*) extending at right angle with said bottom surface, said engaging shoulder provided for receiving said core wire (55-1 or 55-2) of said cable such that said core wire is bent at said engaging shoulder of said inner conductor receiving channel, wherein said male holding block is placed on said male insulation block such that said core wire in said male inner conductor receiving channel is connected under pressure to a plurality of press-connection blades of said male terminal, and said shield and jacket crimping tabs of said shield member (35 and 36) are press-connected to said outer conductor and outer sheath of said cable, respectively; and said female terminal unit comprising:

a female shield member (81);

a female insulation block (82) provided in said female shield member including a shield section (85) and a press-connection section (86) having a pair of shield press-connection tabs (95) and a pair of sheath press-connection tabs (96); and a female holding block having at least one female inner conductor receiving channel (44 or 45) having at least one engaging shoulder (44-1 or 44-2) having a bottom surface (44*a*) and a vertical surface (44*b*) extending at right angles with said bottom surface, said engaging shoulder provided for receiving said core wire (55-1 or 55-2) of said cable such that said core wire is bent at said engaging shoulder of said female inner conductor receiving channel, wherein said female holding block is placed on said female insulation block such that said core wire in said female inner conductor receiving channel is connected under pressure to a plurality of press-connection blades of said female, and said shield and sheath press-connection tabs (95 and 96) of said shield member (85) are press-connected to said outer conductor and outer sheath of said cable, respectively.

7. An electrical connector system consisting of a pair of electrical connectors for an electrical cable (12) including at least one core wire (55-1 and 55-2), an inner sheath (54), an outer conductor (56) and an outer sheath (57), each electrical connector comprising:

a connector housing (10) having a cylindrical housing body (10A); and a terminal unit (20) provided in said connector housing;

one of said electrical connectors being mounted on a surface of a circuit board;

said terminal unit of the other electrical connector comprising:

a shield member (21) including a shield section (25) and a press-connection section (26) having a pair of shield crimping tabs (35) and a pair of jacket crimping tabs (36);

an insulation block (22) provided in said shield member;

a holding block (23) having at least one inner conductor receiving channel (44 or 45), said inner conductor receiving channel extending in a first direction in which said cable is inserted to said inner conductor receiving channel and having at least one engaging shoulder (44-1 or 44-2) having a bottom surface (44*a*) and a vertical surface (44*b*) extending at right angle with said bottom surface, said engaging shoulder provided for receiving said core wire (55-1 or 55-2) of said electrical cable in said inner conductor receiving channel such that said core wire is bent at said engaging shoulder of said inner conductor receiving channel; and at least one terminal (24-1 or 24-2) supported by said insulation block and have a plurality of press-connection blades projecting in a second direction perpendicular to said first direction, wherein said holding block is placed on said insulation block such that core wire of said electrical cable in said inner conductor receiving channel is connected under pressure to said press-connection blades of said terminal, and said shield and jacket crimping tabs of said shield member are press-connected to said outer conductor and outer sheath of said cable, respectively.

8. An electrical connector for a cable (12) including at least one core wire (55-1 and 55-2), an inner sheath (54), an outer conductor (56) and an outer sheath (57), said electrical connector comprising;

a housing (10) having a cylindrical housing body (10A);

a shield member (21) comprising a holding block shield portion (29) including a pair of opposing shield plates (32), and a press-connection section (26) having a pair of shield crimping tabs (35) and a pair of jacket crimping tabs (36);

an insulation block (22) provided in said shield member;

a holding block (23) accommodated in said holding block shield portion and having at least one inner conductor receiving channel (44 and 45), said inner conductor receiving channel extending in a first direction in which said cable is inserted to said inner conductor receiving channel and having at least one engaging shoulder (44-1 or 45-1) which has a bottom surface (44*a*) and a vertical surface (44*b*) extending at right angles with said bottom surface;

at least one terminal (24-1 or 24-2) supported by said insulation block and having a plurality of press-connection blades (40-1 and 40-2) projecting in a direction perpendicular to said direction in which said cable is inserted to said inner conductor receiving channel; and means (33, 34, 50 and 51) for locking said holding block to said shield plates, wherein said holding block is placed on said insulation block such that said core wire of said cable in said inner conductor receiving channel is connected under pressure to said press-connection blades of said terminal, said shield and jacket crimping tabs of said shield member are press-connected to said outer conductor and outer sheath of said cable, respectively, and when said holding block is inserted, said lock means works such that said shield plates are flexed outwardly and then elastically returned to lock said holding block to said shield plates.

* * * * *